US006634639B2

(12) United States Patent
Kuroda et al.

(10) Patent No.: US 6,634,639 B2
(45) Date of Patent: Oct. 21, 2003

(54) PAPER SHEET STACKING APPARATUS

(75) Inventors: Hayato Kuroda, Tokyo (JP); Yasunori Kikuzato, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 10/143,753

(22) Filed: May 14, 2002

(65) Prior Publication Data

US 2002/0171194 A1 Nov. 21, 2002

(30) Foreign Application Priority Data

May 15, 2001 (JP) ..... 2001-145544

(51) Int. Cl.[7] ..... B65H 29/40

(52) U.S. Cl. ..... 271/178; 271/177; 271/207; 271/2; 271/314

(58) Field of Search ..... 271/178, 177, 271/207, 220, 2, 314; 414/798.5; 209/900

(56) References Cited

U.S. PATENT DOCUMENTS 1,632,648 A * 6/1927 Gray ..... 156/442.2
2,844,373 A * 7/1958 Van Marle ..... 271/178
3,035,695 A * 5/1962 Butchwald et al. ..... 209/643
3,139,278 A * 6/1964 Maidment ..... 271/188
3,865,365 A * 2/1975 Hardin et al. ..... 271/214
4,273,491 A * 6/1981 Roux ..... 414/798.8
4,322,068 A * 3/1982 Cayn et al. ..... 271/207
5,135,352 A * 8/1992 Scata et al. ..... 414/798.8
5,211,389 A * 5/1993 Roch et al. ..... 271/207
5,443,253 A * 8/1995 Dale et al. ..... 271/177
6,250,625 B1 * 6/2001 Janatka et al. ..... 271/65
6,398,204 B1 * 6/2002 Keane et al. ..... 271/2

FOREIGN PATENT DOCUMENTS

JP 1-132643 9/1989
JP 05278924 A * 10/1993 ..... B65H/31/36

* cited by examiner

*Primary Examiner*—Donald P. Walsh
*Assistant Examiner*—Matthew J. Kohner
(74) *Attorney, Agent, or Firm*—McGinn & Gibb, PLLC

(57) ABSTRACT

As a rotary member 21 provided on the back surface side of a guide 5 is rotated, its blades get out to the front surface side through a window 8 formed in the guide 5. With this rotation, the height level of the blades getting out from the window 8 is changed. With the rotation of the rotary member 21, postal matter being led reaches a side plate 3. A bottom plate 2 is slanted such that its side, on which the guide 5 is provided, is higher in level than the opposite side 53. Owing to this slant, a support plate 4 receives gravitational force of the postal matter stack. A wire 16 is held stretched between a holder slide 7 and a wire mounting member 17. Springs 14 and 15 are elongated with movement of the support plate 4 caused by the gravitational force of the stack. The springs 14 and 15 provide increasing forces tending to restore their initial length with their elongation.

31 Claims, 7 Drawing Sheets

PRIOR ART

PAPER SHEET STACKING APPARATUS

BACKGROUND OF THE INVENTION

This application claims benefit of Japanese Patent Application No. 2001-145544 filed on May 15, 2001, the contents of which are incorporated by the reference.

The present invention relates to a paper sheet stacking apparatus and, more particularly, to a paper sheet stacking apparatus for stacking paper sheets in upright state.

Post offices or the like use paper sheet stacking apparatus for stacking postal matter. FIG. 7 is a perspective view showing an example of paper sheet stacking apparatus disclosed in Japanese Utility Model Laid-Open No. 1-132643. As shown, paper sheets 180 are clamped between belts 181 and 182, and are transported to a space between a support plate 104 and a stacking roller 105 as the belts 181 and 182 undergo excursion. With increase of the paper sheets 190 stacked between the support plate 104 and the stacking roller 105, the support plate 104 is displaced away from the stacking roller 105. The paper sheets stacked in the paper sheet stacking apparatus is referred as paper sheet stack.

To the support plate 104 is applied a predetermined force toward the support plate 104. With the force applied to it toward the stacking roller 105, it clamps the paper sheet stack 190 between it and the stacking roller 105, thus supporting the paper sheets 190 to prevent turning-down thereof. The paper sheet stack 190 are stacked such that their stack relays on the support plate 104. With increase of the stack quantity of the paper sheets 190 a holder slide 107 is displaced along a guide bar 106.

To apply a predetermined force to the support plate 104, the holder slide 107 is pulled with a weight or a constant load spring (not shown in FIG. 7). The constant load spring is one which provides a constant force tending to cause its restoration to the initial length without spring elongation.

With the rotation of the stacking roller 105, each paper sheet 180 transported to the space between the stacking roller 105 and the support plate 104 is moved until its leading end 180*a* reaches a side plate 103. The paper sheet stack 190 thus has a neat leading end 190*a* aligned by the side plate 103.

The apparatus is preferably arranged such that each paper sheet 180 is transported to the space between the stacking roller 105 and the support plate 104 without its leading end 180*a* touching the trailing end 190*b* of the paper sheet stack 190. To this end, a belt (not shown in FIG. 7) is provided on the bottom plate 102 and driven for excursion to have the paper sheet stack 190 pushed against the support plate 104. FIG. 8 is a view showing a state that the paper sheet stack 190 is pushed against the support plate 104 by the belt. The belt 191 is provided such as to surround the bottom plate, and undergoes excursion on the top surface of the bottom plate 102 from the side of the stacking roller 105 toward the support plate 104. The paper sheet stack 190 formed upright on the belt 191 is pushed by the belt 191 against the support plate 104. Consequently, the leading end 180*a* of each transported paper sheet 180 difficultly touches the trailing end 190*b* of the paper sheet stack 190 and is thus smoothly stacked.

However, in the case of providing the belt 191 on the bottom plate 191 for pushing the paper sheet stack 190 against the support plate 104, a motor or the like for driving the belt 191 is necessary. To simplify the construction of the paper sheet stacking apparatus, the use of the belt 191 and the motor or the like for driving the belt 191 is undesired.

Besides, the support plate 104 supports the paper sheet stack 190 with a predetermined force applied thereto toward the stacking roller 105. Since the constant force is applied to the support plate 104 toward the stacking roller 105, and the support plate 104 supports the paper sheet stack 190 with a constant force irrespective of the increase of the volume of the paper sheet stack 190. On the other hand, the force, with which the paper sheet stack 190 tends to relay on the support plate 104, tends to increase with increasing volume of the paper sheet stack 190. Therefore, when the force of relaying on the support plate 104 by the paper sheet stack 190 exceeds the force, with which the support plate 104 tends to support the paper sheet stack 190, the support plate 104 can no longer support the stack 190, thus resulting in turning-down thereof.

When its leading end 180*a* reaches the side plate 103, the paper sheets 180 are stopped and stacked as the paper sheet stack 190. On the other hand, the stacking roller 105 is continuously rotated. This means that each stopped paper sheet is in contact with the rotating stacking roller 105 until the next paper sheet is transported. However, less time of contact of the paper sheet with the stacking roller 105 will be preferred.

SUMMARY OF THE INVENTION

An object of the present invention is to provide a paper sheet stacking apparatus capable of stacking paper sheets in the upright state with a simple construction.

Another object of the present invention is to provide a paper sheet stacking device capable of stacking paper sheets in the upright state irrespective of increase of the volume of the stack.

A further object of the present invention is to provide a paper sheet stacking apparatus capable of reducing the time of contact of each paper sheet to be stacked with a rotating member.

According to an aspect of the present invention, there is provided a paper sheet stacking apparatus for stacking paper sheets upright comprising: a bottom plate for stacking paper sheets being led upright; a side plate for stopping paper sheets led to the bottom plate; a rotary member rotated to intermittently touch the paper sheets being led and bring the paper sheets to the position of the side plate; a support member facing the rotary member and preventing the paper sheets being led upright from turning down onto the bottom plate; a guide bar, along which the support is moved to change the distance between the support plate and the rotary member; and a spring member pulling the support toward the rotary member; the bottom plate being slanted such that the paper sheets led upright into the apparatus are slanted toward the support.

The spring member provides increasing force tending to restore its initial length with its increasing elongation. With this construction, even with paper sheet stack volume increase, it is possible to prevent the turn-down of the stack which may otherwise occur when the support can no longer support the stack.

In the paper sheet stacking apparatus, a plurality of springs having different spring strengths pull the support toward the rotary member. The apparatus further comprises a stopper for stopping further elongation of the spring having less spring strength from a predetermined elongation, or a stopper disposed such as to determine the position, at which the spring having higher spring strength becomes active when the gravitational force of the stack due to volume increase thereof exceeds the spring strength of the spring having less spring strength. With this construction, when one of the spring members can no longer support the paper sheet stack, that spring member strikes the stopper, and the stack is supported by the other spring member. Thus, it is possible to prevent the turn-down of the stack.

The paper sheet stacking apparatus further comprises a wire having one end tied to the support and the other end secured at a fixed position and a movable pulley with the wire passed thereround, the spring member pulling the support toward the rotary member by pulling the movable pulley.

In the paper sheet stacking apparatus, as a plurality of spring members having different spring strengths are provided, the wire is passed round a plurality of movable pulleys, and each spring member pulls the support toward the rotary member by pulling each movable pulley. The apparatus further comprises a stopper for stopping further elongation of the spring having less spring strength from a predetermined elongation, or a stopper disposed such as to determine the position, at which the spring having higher spring strength becomes active when the gravitational force of the stack due to volume increase thereof exceeds the spring strength of the spring having less spring strength.

In the paper sheet stacking apparatus, the rotary member has two or more blades, each blade being capable of touching a paper sheet stack. In the paper sheet stacking apparatus, the blades of the rotary member each have an L-shaped free end.

In the paper sheet stacking apparatus, a guide for preventing the paper sheets being led from proceeding toward the rotation axis of the rotary member, and the guide has a window, through which the rotary member partly gets out the side of the support. With this structure, the paper sheets is prevented from proceeding toward the rotation axis, making it possible to smoothly stack the paper sheets.

In the paper sheet stacking apparatus, the bottom plate is higher in level on its side, on which the paper sheets are led into the apparatus, than the side with the side plate provided thereon. With this construction, the paper sheet led into the apparatus can be reliably led by the rotary member up to the side plate.

Other objects and features will be clarified from the following description with reference to attached drawings.

PREFERRED EMBODIMENTS OF THE INVENTION

Preferred embodiments of the present invention will now be described with reference to the drawings.

Figure 1:
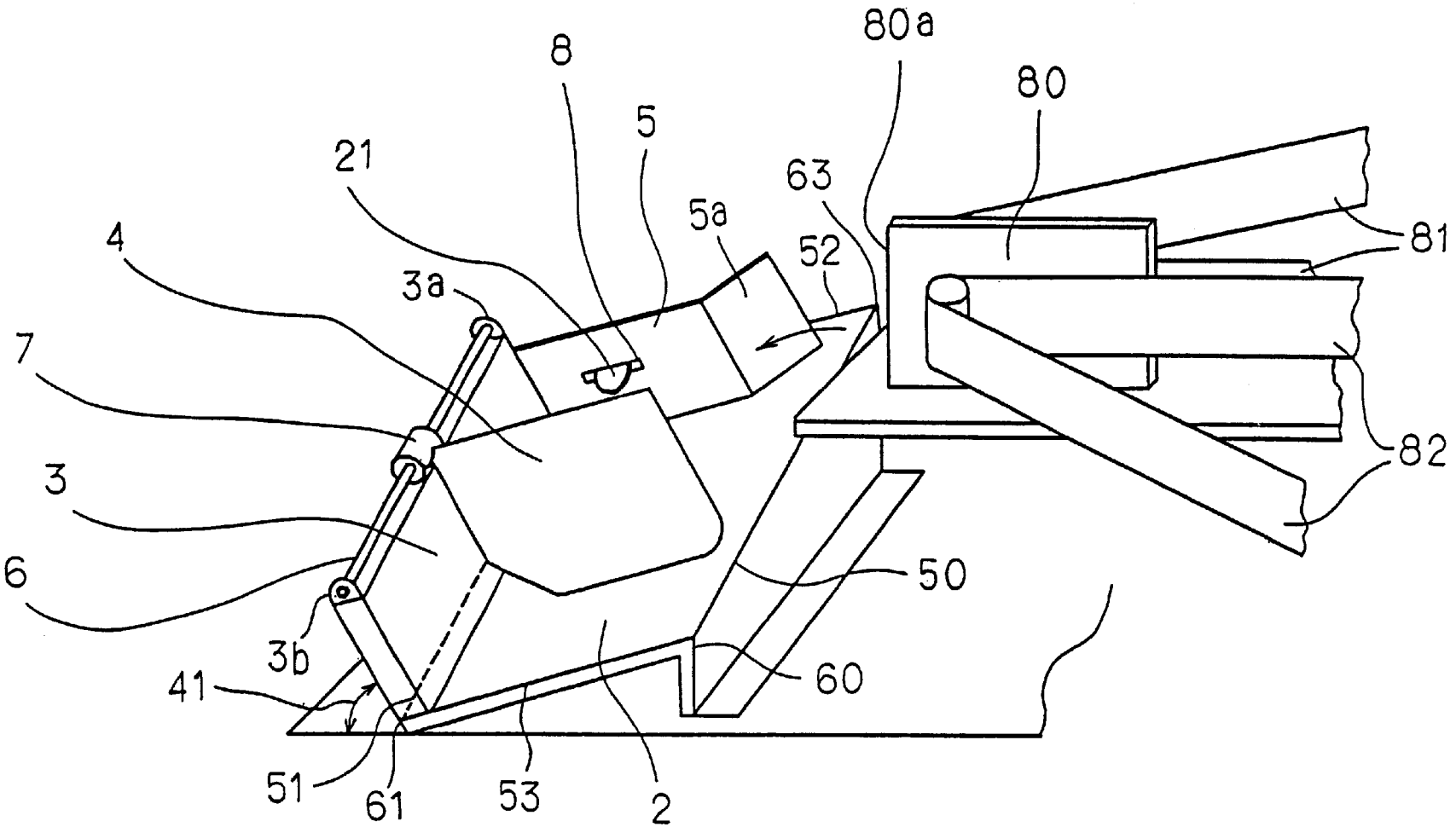
FIG. 1 shows a perspective view of a postal matter stacking apparatus according to an embodiment of the present invention.
Figure 2:
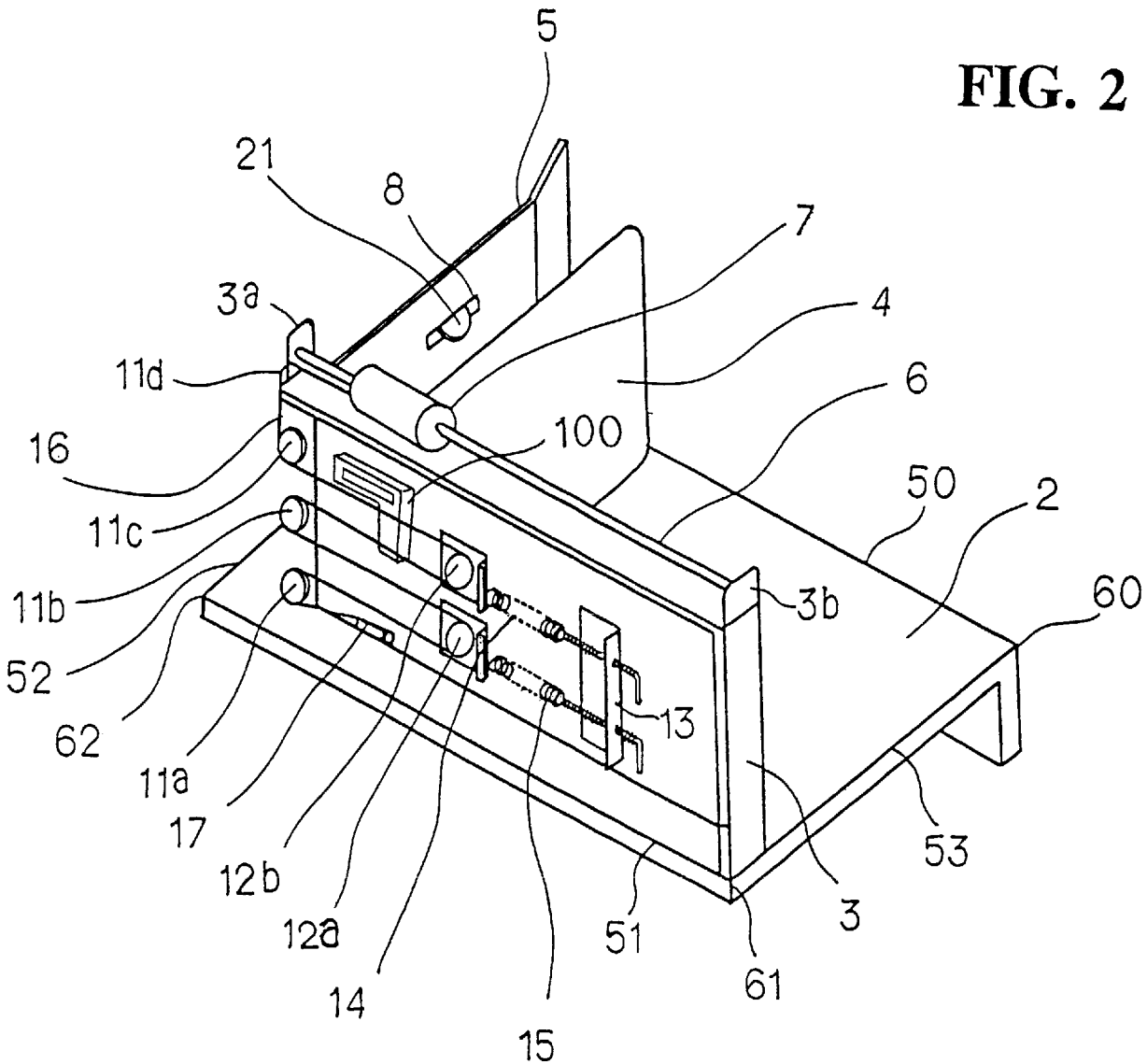
FIG. 2 shows a perspective of an example of the back surface side of the side plate 3 in the embodiment.

An example will now be described, in which postal matter is transported as paper sheets for stacking in the paper sheet stacking apparatus. FIG. 1 shows a perspective view of a postal matter stacking apparatus as an embodiment of the paper sheet stacking apparatus according to the present invention. The postal matter stacking apparatus comprises a bottom plate for stacking postal matter thereon, a side plate 3 for supporting the postal matter against turn down (fall down) the bottom plate 2, a support plate 4 supporting the postal matter such that the postal matter can be stacked in the upright state without turn down, and a guide 5 for leading transported postal matter to the inside of the postal matter stacking apparatus. The guide 5 and the support plate 4 are faced. The guide 5, the support plate 4 and the side plate 5 define a space on the bottom plate 2 in three directions. The side plate 3, the support plate 4 and the guide 5 are upright with respect to the bottom plate 2. Postal matter 80 are led into the bottom plate 2 from the side thereof opposite the side plate 3, and stacked in the space defined by the guide 5, the support plate 4 and the side plate 3. The postal matter 80 is led in the upright state, and stacked in the upright state. The stacked postal matter will be hereinafter referred to as postal matter stack. The surfaces of the guide 5 and the side plate 3 that face the postal matter stacking space are referred to as front surface, while the surfaces on the side opposite the postal matter stacking space are referred to as back surface. FIG. 2 shows a perspective of an example of the back surface side of the side plate 3.

As shown in FIG. 1, postal matter 80 is held clamped upright between two belts 81 and 82. The postal matter 80 is transported as the belts 81 and 82 clamping it therebetween undergo excursion.

In the bottom plate 2, corner 60 is found at a position higher in level than corner 61. Likewise, corner 63 is found at a higher position than corner 62. With this arrangement, the bottom plate 2 is slanted such that its side 50, from which the postal matter is led into the device, is higher in level than the side, in which the side plate 3 is provided.

Furthermore, the corner 62 is found at the higher position in level than the corner 61. Likewise, the corner 63 is found at the higher position than the corner 60. With this arrangement, the bottom plate 2 is slanted that its side 52, on which the guide 5 is provided, is higher in level than opposite side 53.

Figure 3:
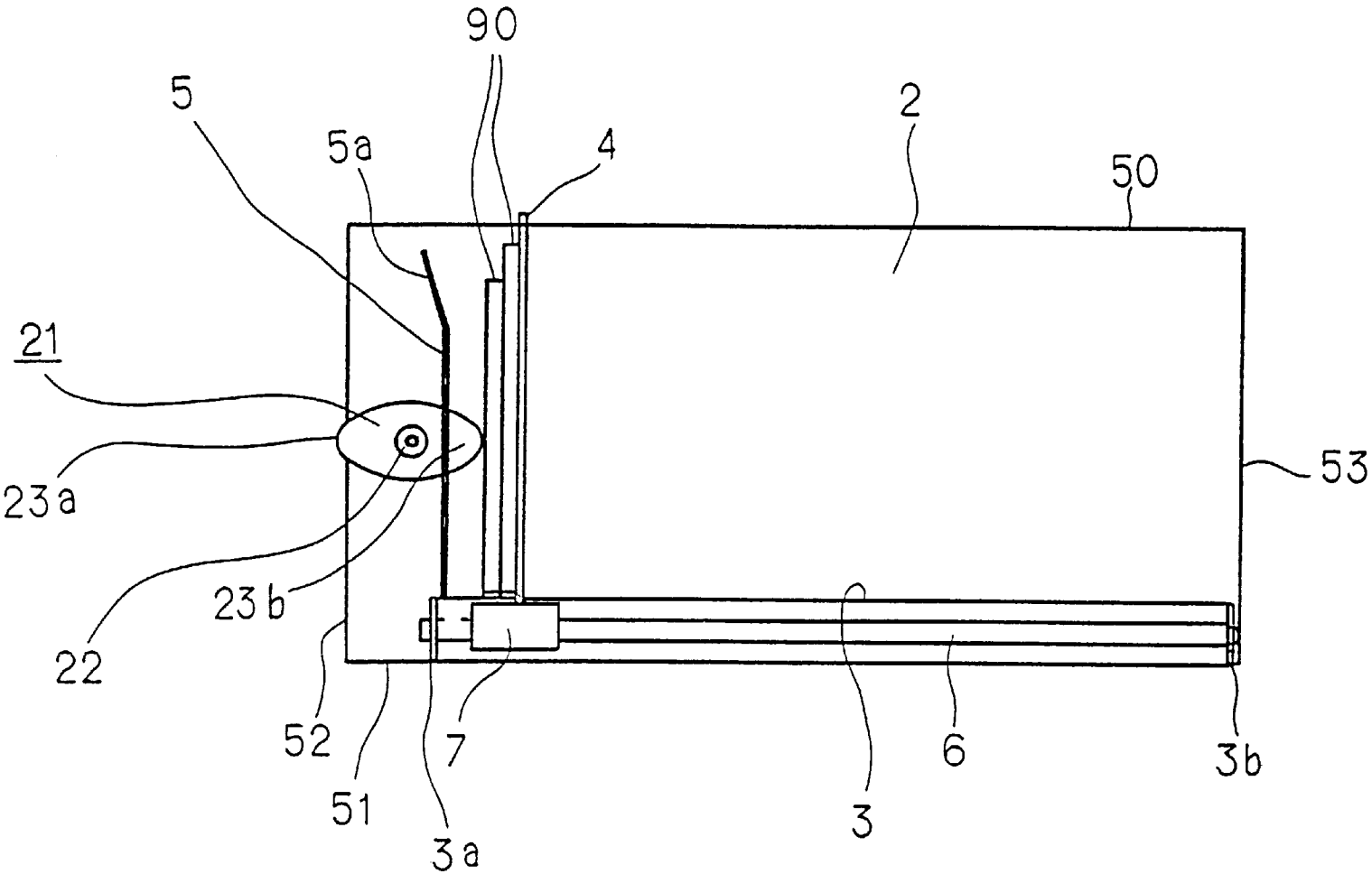
FIG. 3 illustrates how the rotary member 21 gets out of the guide 5 formed in the bottom plate 2 in the embodiment.

The guide 5 is a bent plate, and it is disposed between the rotation axis of a rotary member (plate) 21 and the support plate 4. The guide 5 has a window 8, and the rotating rotary member 21 partly gets out of the window 8. FIG. 3 illustrates how the rotary member 21 gets out of the guide 5 formed in the bottom plate 2. As shown in FIG. 3, the rotating shaft 22 of the rotary member 21 is located on the back surface side of the guide 5. The rotary member 21 is rotated at a fixed rate of rotation.

The guide 5 has a bent portion 5*a* provided on the side, from which the postal matter 80 is led thereinto. The bent portion 5*a* is bent toward the side opposite the side, on which the postal matter 80 is stacked. The bent portion 5*a* serves to prevent the postal matter 80 from being led toward the rotation axis 22 of the rotary member 21.

The rotary member 21 has one or more blades. FIG. 3 shows an example of rotary member 21 having two blades 23*a* and 23*b*. With the rotation of the rotary member 21, the blades 23*a* and 23*b* alternatively get out from the window 8. The rotary member 21 is rotated such that its blades 23*a* and 23*b* getting out from the window 8 are moved from the side 50 toward the side 51. In the illustrated example, the rotary member 21 is rotated clockwise in the top view of the postal matter stacking device. Since the blades 23*a* and 23*b* alternatively getting out from the window 8 are moved from the side 51 toward the side 51, when the postal matter 80 is brought into contact with the blades 23*a* and 23*b*, it is transported toward the side plate 3. The side plate 3 stops the postal member 80 when it is reached by the leading end 80*a* of the postal matter 80.

The rotary member 21 is made of such material as rubber, plastics, silicon and iron. These materials are by no means limitative, it is also possible that the rotary member 21 is made of other materials.

The side plate 3 is perpendicular to the bottom plate 2, which is slanted such that its side 50 is higher in level than its side 51. Thus, as shown in FIG. 1, the side plate 3 has an inclination angle 41 with respect to the surface, on which the postal matter stacking apparatus is installed. The side plate 3 has a guide bar 6.

The guide bar 6 penetrates a holder slide 7 slidable along it. The support plate 4 is provided on the holder slide 7. The distance between the support plate 4 and the rotary member 21 is thus variable with sliding of the holder slide 7 along the guide bar 6. The side plate 3 further has stoppers 3*a* and 3*b* for stopping the holder slide 7. The support plate 4 faces the rotary member 21 and the guide 5. In this embodiment, the support plate 4 and the holder slide 7 constitute a support.

The length dimension of the holder slide 7 in the direction of the guide bar 6 is greater than the thickness of the support plate 4. The support plate 4 is provided on the holder slide 7 such that a space is defined between the support plate 4 and the guide 5 when the holder slide 7 is brought into contact with the stopper 3*a*. The width of the space defined when the holder slide 7 is brought into contact with the stopper 3*a* is matched to the level of the blades 23*a* and 23*b* getting out utmost from the window 8 of the rotary member 21. More specifically, with the holder slide 7 in contact with the stopper 3*a*, the free ends of the blades 23*a* and 23*b* touch the support plate 4 when the blades 23*a* and 23*b* get out utmost from the window 8.

In this postal matter stacking apparatus, fixed pulleys 11*a* to 11*d* are provided in the vicinity of the side plate 3. More specifically, the fixed pulleys 11*a* to lid are mounted on a bracket (not shown), which is in turn mounted on the side plate 3.

The side plate 3 further has a spring mounting member 13, which supports a plurality of springs 14 and 15. The springs 14 and 15 are not fixed load springs, but their force tending to restore their initial length increase with their increasing elongation. The springs 14 and 15 have different spring strengths. In this embodiment, it is assumed that the spring strength of the spring 15 is higher than that of the spring 14. Movable pulleys 12*a* and 12*b* are tied to the free end of the springs 14 and 15, respectively.

A wire 16 has one end secured to the holder slide 7 and the other end secured to a wire mounting member 17 provided on the side plate 3. The wire 16 led out from the wire mounting member 17 is passed round the fixed pulley 11*a*, the movable pulley 12*a*, the fixed pulley 11*b*, the movable pulley 12*b* and the fixed pulleys 11*c* and lid in the mentioned order and secured to the holder slide 7. The forces with which the springs 14 and 15 pull the movable pulleys 12*a* and 12*b*, hold the wire 16 between the wire mounting member 17 and the holder slide 7.

The bottom plate 2 is slanted such that its side 52 is higher in level than its side 53. Thus, the support plate 4 receives how gravitational force of the postal matter 80 having been stacked. The support plate 4 receiving the gravitational force of the postal matter stack is pushed down along the guide bar 6. At this time, the wire 16 secured to the holder slide 7 is pulled by the gravitational force of the postal matter stack, thus causing elongation of the spring 14 to cause displacement of the movable pulley 12*b* toward the guide 5. The support plate 4 is thus displaced up to a position, at which the gravitational force of the postal matter stack and the support plate 4 and the spring force are in equilibrium. Since the spring 14 has less spring strength than that of the spring 15, is elongated in advance to the spring 15. With increase of the paper sheet stack, the wire 16 is further pulled, and the elongated spring 14 strikes and is stopped by a stopper 100. Subsequently, the spring member 15 having greater spring strength than the spring member 14 is elongated while supporting the support, and the dynamic pulley 12*a* is displaced toward the guide 5.

The operation of the postal matter stacking apparatus will now be described.

Without any stacked postal matter, the holder slide 7 pulled by the wire 16 is in contact with the stopper 3*a*. In this state, a space is formed between the support plate 4 and the guide 5, and the free ends of the blades 23*a* and 23*b* of the rotary member 21 touch the support plate 4 when the blades 23*a* and 23*b* get out utmost from the window 8. Because the rotary member 21 is rotating, without any stacked postal matter the free ends of the blades 23*a* and 23*b* appear alternately, and the plate intermittently touches the support plate 4.

The postal matter 80 is clamped between the belts 81 and 82, and is transported on the upright state. The postal matter 80 transported by the belts 81 an 82 under excursion, is led into the space between the support plate 4 and the guide 5. The bent portion 5*a* of the guide 5 prevents the postal matter being led from proceeding toward the rotation axis 22, and the guide 5 thus leads the postal matter into the space between the support plate 4 and the guide 5.

Since the bottom plate 2 is slanted such that its side 50 is higher in level than its side 51, the transported postal matter 80 reaches the rotary member 21 getting out from the window 8. Since the rotary member 21 is rotating, it moves the postal matter 80 in contact with it until its leading end 80*a* reaches the side plate 3. The height level of the blades 23*a* and 23*b* getting out from the window 8 is changed with the rotation. Thus, the postal matter 80 having reached the side plate 3 is not always in contact with the rotary member 21. That is, the postal matter 80 is brought into contact with the rotary member 21 when the height level of the blades 23*a* and 23*b* getting out from the window 3 is increased, and gets out of contact when the height level is reduced. The rotary member 21 thus intermittently touches the postal matter 80.

Also, since the bottom plate 2 is slanted such that its side 52 is higher in level than the side 53, the postal matter 80 is slanted as one goes toward the support plate 4. The postal matter 80 is flapped and pushed against the support plate 4 by the blades 23*a* and 23*b*. The postal matter 80 is supported by the support plate 4 in its state pushed thereagainst. The transported postal matter 80 is stacked to form the postal matter stack 90.

Figure 4:
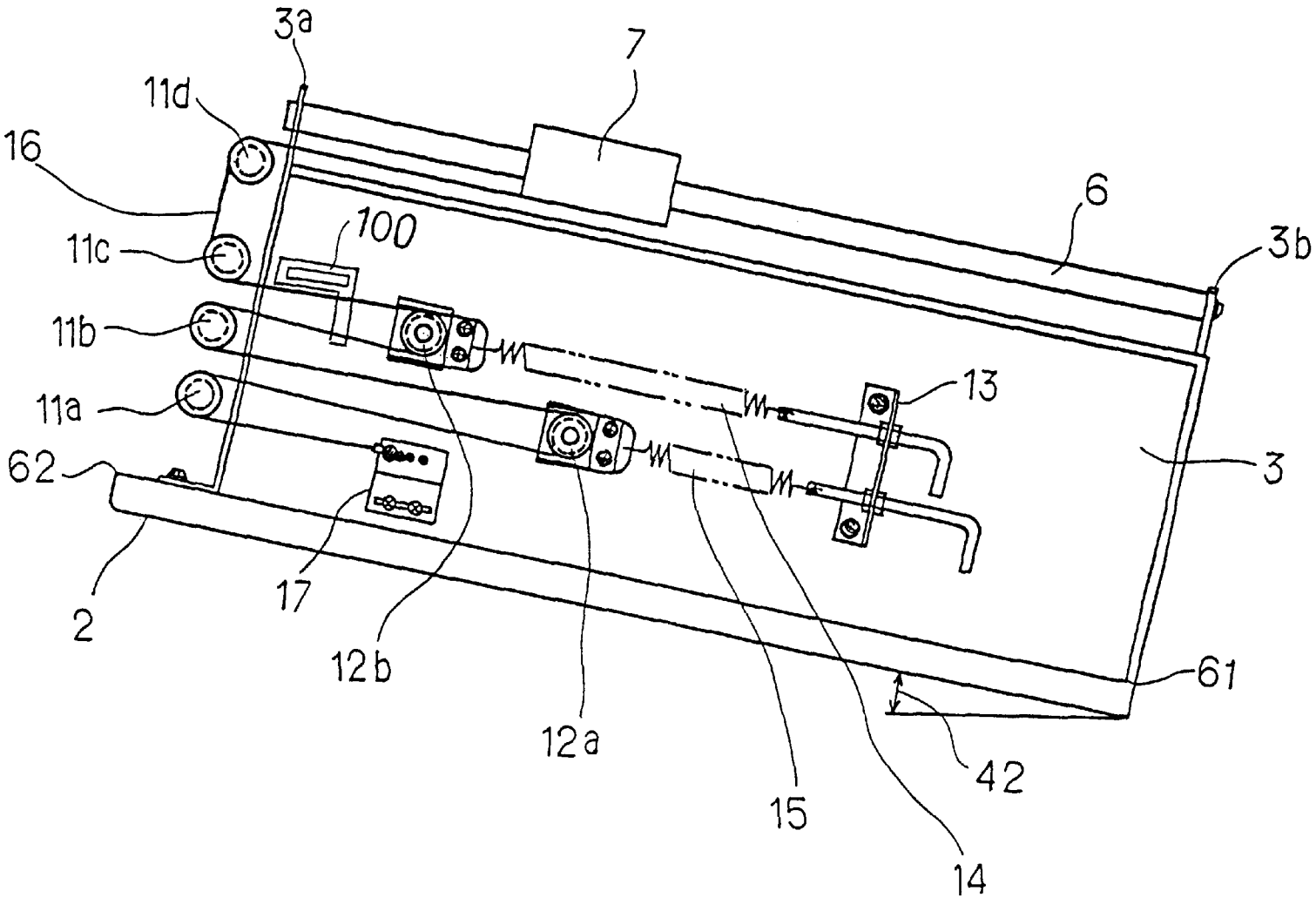
FIG. 4 is a view illustrating the back surface of the side plate 3 when postal matter is stacked in the embodiment.

FIG. 4 is a view illustrating the back surface of the side plate 3 when postal matter is stacked. The corner 62 is disposed at a level higher than the corner 61. Thus, the bottom plate 2 makes an inclination angle 42 with respect to the horizontal plane. The support plate 4 supporting the postal matter stack 90 receives gravitational force thereof. With this gravitational force, the holder slide 7 receives a force exerted toward the stopper 3*b*, and the holder slide 7 and the support plate 4 are moved toward the stopper 3*b*. Also, the wire 16 is pulled by the holder slide 7, thus causing pulley movement. At this time, the movable pulley 12*b* which is tied to the less spring strength spring 14 is first caused to undergo motion. The spring 14 is elongated as the pulley 12*b* is pulled by the wire 16.

Succeedingly transported postal matter pieces are stacked likewise. The postal matter is caused by the rotating plate 21 until its reading end reaches the side plate 21. Since the bottom plate 2 is tilted such that it side is at a higher level than its side 21, the postal matter is slanted toward the support plate 4. The postal matter is then flapped by and pushed against the support plate 4 by the rotary member 21. As the postal matter stack 90 increases in volume, the holder side 7 and the support plate 4 are moved toward the stopper 3*b*.

Figure 5:
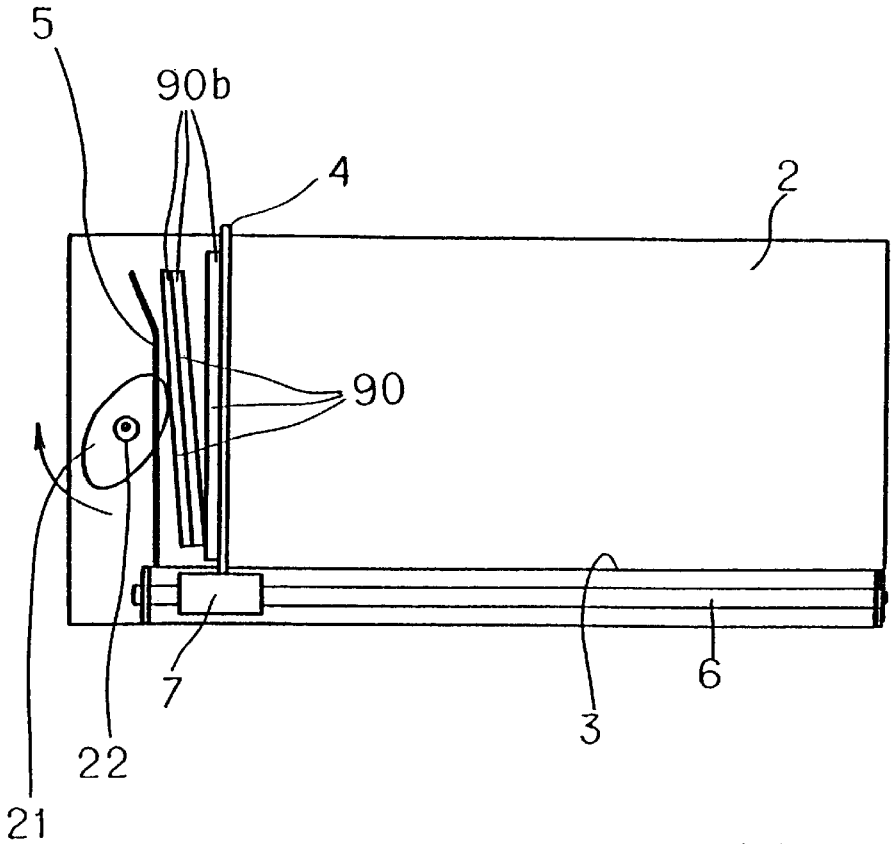
FIGS. 5(*a*) and 5(*b*) are views illustrating a status that new postal matter 80 is transported in the presence of the postal matter stack 90 in the embodiment.
Figure 5:
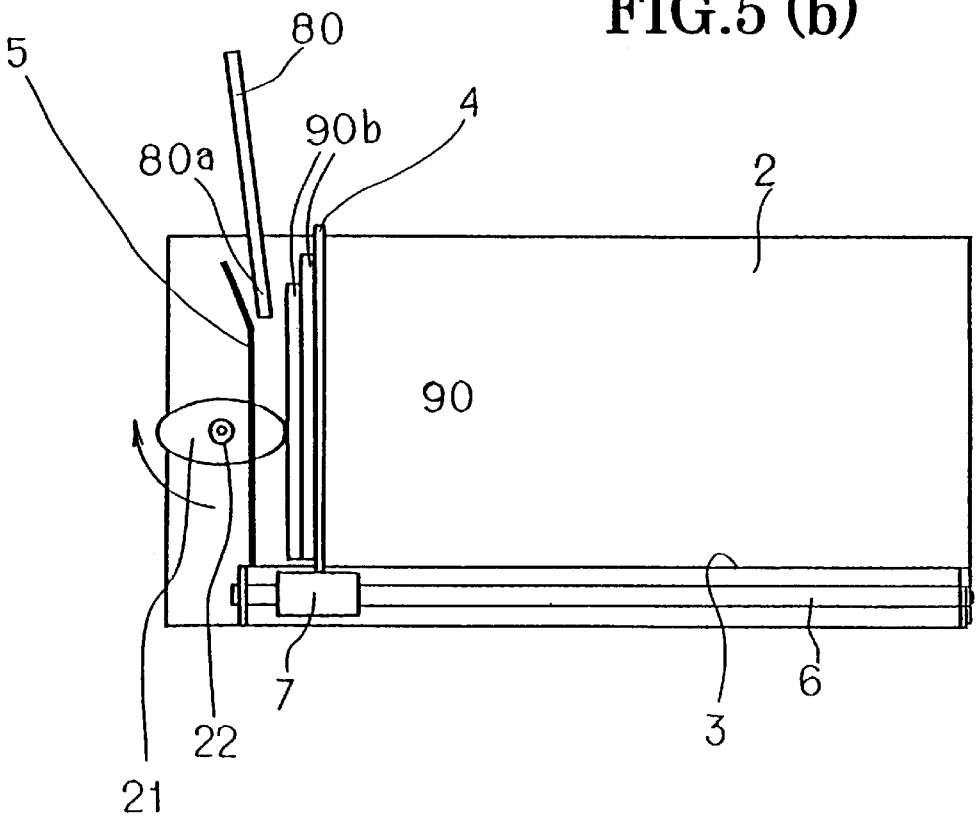

FIGS. 5(*a*) and 5(*b*) are views illustrating a status that new postal matter 80 is transported in the presence of the postal matter stack 90. As shown in FIG. 5(*a*), if a status that the postal matter stack 90 is not dense but has spaces formed between adjacent postal matter pieces, the leading end 80*a* of the newly transported postal matter 80 strikes, thus disabling smooth stacking thereof. In this embodiment, however, the postal matter stack 90 is slanted toward the support plate 4 and flapped by the rotary member 21. Thus, as shown in FIG. 5(*b*), the postal matter is densely stacked. That is, the leading end 80*a* of the newly transported postal matter 80 does not strike the trailing end of the postal matter stack 90, and the newly transported postal matter can be smoothly stacked.

When the postal matter stack 90 is increased in volume so that its gravitational force exerted to the support plate 4 is increased, not only the spring 14 but also the spring 15 is elongated. That is, with the movement of the support plate 4, not only the movable pulley 12*b* but also the movable pulley 12*a* pulled by the wire 16 is moved. The springs 14 and 15 are not fixed load springs, but their forces tending to restore their initial length are increased with increase of their elongation. The stopper 100 is disposed at a length position, at which the increase of gravitational force of the stack 90 with volume increase thereof exceeds the pulling force of the spring member 14, so that only the spring member 15 having greater spring strength than the spring member 14 is active. Thus, even with volume increase of the postal matter stack 90, the springs 14 and 15 can pull the holder slide 7 via the wire 16. Consequently, the postal matter stack 90 can be supported irrespective of its increase in volume.

According to the present invention, the bottom plate 2 is slanted such that the postal matter 80 led into the apparatus is slanted toward the support plate 4, and the postal matter is flapped by and pushed against the support plate 4 by the blades 23*a* and 23*b* of the rotary member 21. Thus, no belt need be provided on the bottom plate, and it is possible to simplify the construction of the paper sheet stacking apparatus.

Also, according to the invention, spring members 14 and 15 having different lengths are used, so that the spring member 15 having greater spring strength than the spring member 14 is active when the gravitational force of the stack due to volume increase thereof exceeds the spring strength of the spring member 14. Thus, the postal matter stack can be supported irrespective of its increase in volume. Furthermore, by increasing the springs in number, it is possible to increase the capacity of stacking postal matter.

Moreover, the postal matter stack touches the rotary member 21 when the height level of the blades 23*a* and 23*b* getting out form the window 8 is increased. This means that it is possible to reduce the time of contact between the rotary member 21 and the postal matter stack.

While in this embodiment two springs are used, it is possible to let the wire be pulled by three or more springs.

Figure 6:
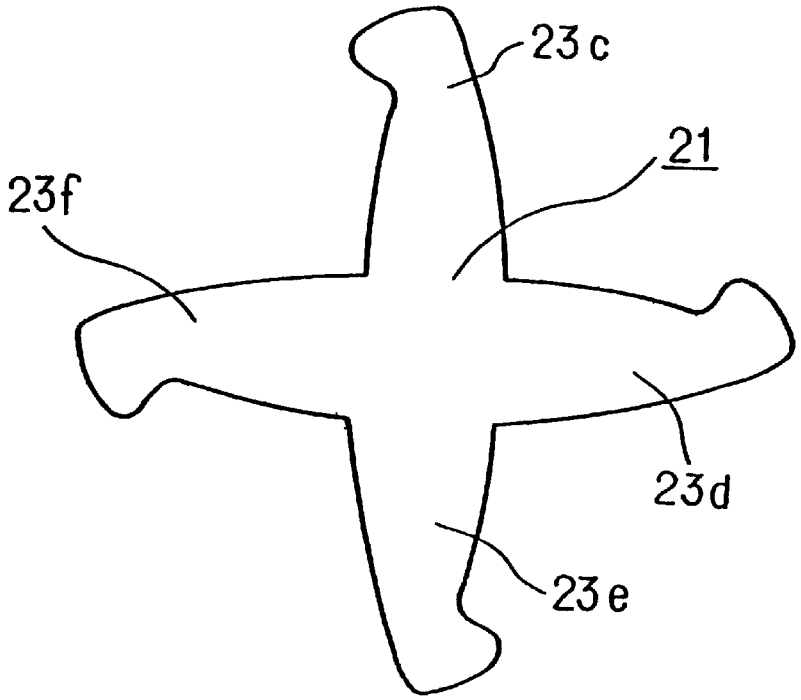
FIG. 6 shows a different example of the rotary plate, which has four blades 23*c* to 23*f* each having an L-shaped free end in the embodiment.
Figure 8:
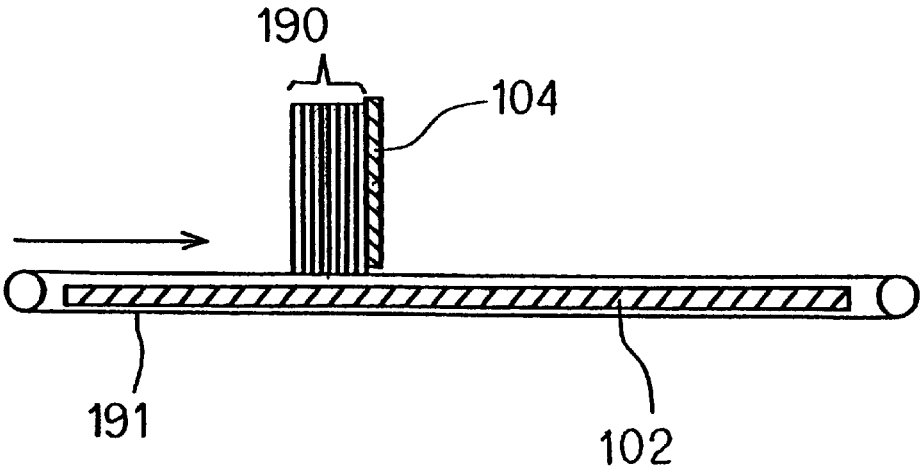
FIG. 8 is a view showing a state that the paper sheet stack 190 is pushed against the support plate 104 by the belt in FIG. 7.
Figure 7:
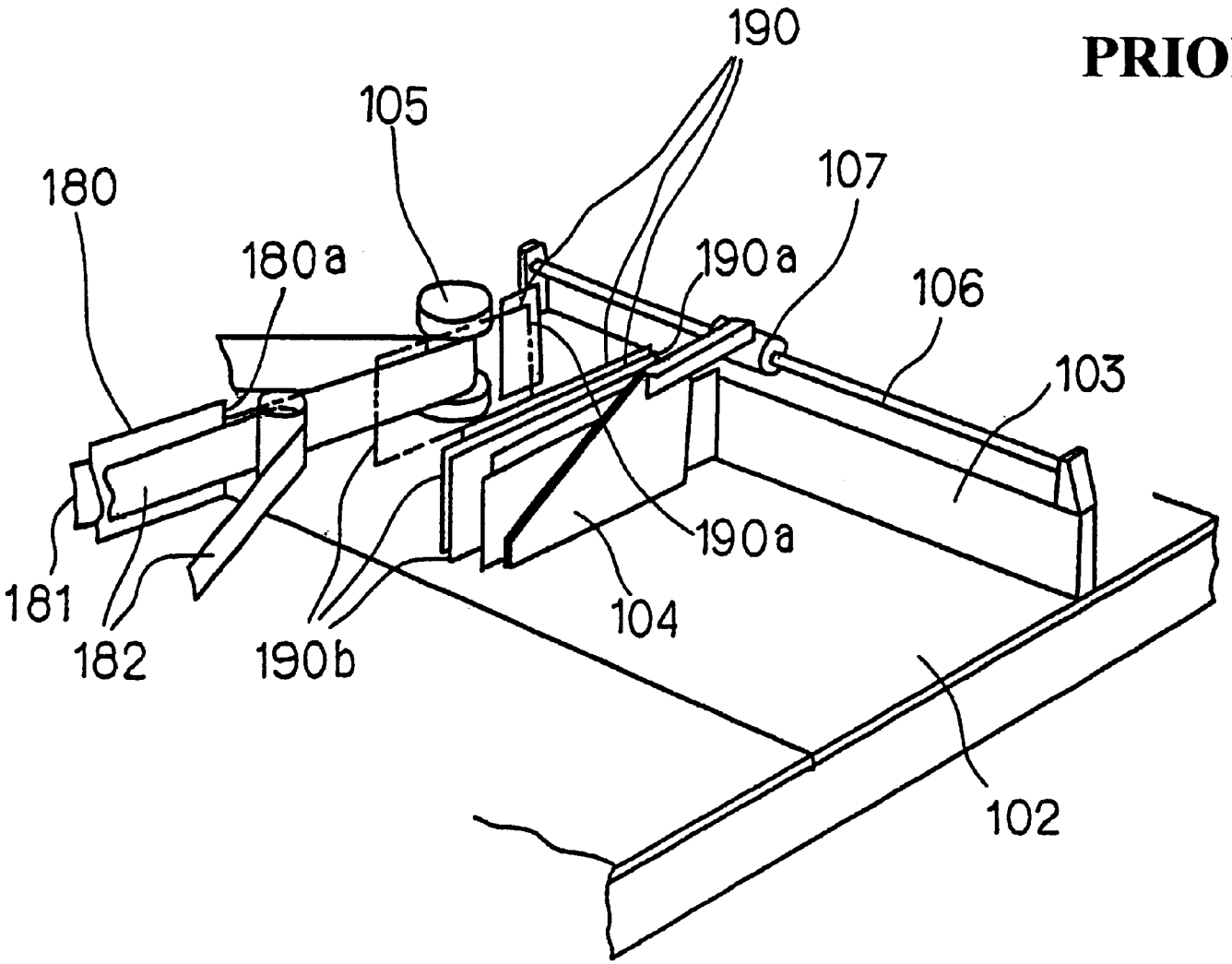
FIG. 7 PRIOR ART
FIG. 7 is a perspective view showing an example of prior art paper sheet stacking apparatus.

While in the above embodiment the rotary member 21 has the blades 23*a* and 23*b*, the rotary member 21 may have only a single blade or three or more blades. The blade may have an L-shaped free end. FIG. 6 shows a different example of the rotary plate, which has four blades 23*c* to 23*f* each having an L-shaped free end. It is possible to provide such a rotary member on the back surface of the guide 5.

As has been described in the foregoing, there are provided a bottom plate for stacking paper sheets led upright, a side plate for stopping paper sheets led to the bottom plate, a rotary member rotated to intermittently touch the paper sheets being led and bring the paper sheets to the position of the side plate, a support facing the rotary member and preventing the paper sheets being led upright turning down onto the bottom plate, a guide bar, along which the support is moved to change the distance between the support plate and the rotary member, a spring member pulling the support toward the rotary member, and a stopper disposed such as to determine the position, at which the spring member 15 becomes active when the gravitational force of the stack due to volume increase thereof exceeds the spring strength of the spring member 14. The bottom plate is slanted such that the paper sheets led upright into the apparatus are slanted toward the support. Thus, the paper sheets are pushed against the support without need of providing any belt or the like on the bottom plate. It is thus possible to realize paper sheet stacking apparatus having a simple construction. Also, since the rotary member intermittently touches the paper sheet stack, it is possible to reduce the time of contact between the rotating rotary member and the paper sheet stack.

Changes in construction will occur to those skilled in the art and various apparently different modifications and embodiments may be made without departing from the scope of the present invention. The matter set forth in the foregoing description and accompanying drawings is offered by way of illustration only. It is therefore intended that the foregoing description be regarded as illustrative rather than limiting.

What is claimed is:

1. A paper sheet stacking apparatus for stacking paper sheets upright comprising:

a bottom plate for stacking paper sheets being led upright;

a side plate mounted above the bottom plate for stopping paper sheets led to the bottom plate;

a rotary member mounted above the bottom plate and having at least a blade rotated to intermittently touch the paper sheets being led to the bottom plate and to position the paper sheets proximate to the side plate;

a support member facing the rotary member and preventing the paper sheets being led upright from turning down onto the bottom plate;

a guide bar, along which the support member is moved to change the distance between the support member and the rotary member; and a spring member pulling the support member toward the rotary member, the bottom plate being slanted such that the paper sheets led upright into the apparatus are slanted toward the support member.

2. The paper sheet stacking apparatus according to claim 1, wherein the spring member provides increasing force tending to restore its initial length with its increasing elongation.

3. The paper sheet stacking apparatus according to claim 1, wherein a plurality of springs having different spring strengths pull the support toward the rotary member.

4. The paper sheet stacking apparatus according to claim 3, further comprising a stopper for stopping further elongation of the spring having less spring strength from a predetermined elongation.

5. The paper sheet stacking apparatus according to claim 3, further comprising a stopper disposed such as to determine the position, at which the spring having higher spring strength becomes active when the gravitational force of the stack due to volume increase thereof exceeds the spring strength of the spring having less spring strength.

6. The paper sheet stacking apparatus according to claim 1, which further comprises a wire having one end tied to the support member and the other end secured at a fixed position and a movable pulley with the wire passed thereround, the spring member pulling the support member toward the rotary member by pulling the movable pulley.

7. The paper sheet stacking apparatus according to claim 6, wherein as plurality of spring members haying different spring strengths are provided, the wire is passed round a plurality of movable pulleys, and each spring member pulls the support member toward the rotary member by pulling each movable pulley.

8. The paper sheet stacking apparatus according to claim 7, further comprising s stopper for stopping further elongation of the spring having less spring strength from a predetermined elongation.

9. The paper sheet stacking apparatus according to claim 7, further comprising a stopper disposed such as to determine the position, at which the spring having higher spring strength becomes active when the gravitational force of the stack due to volume increase thereof exceeds the spring strength of the spring having less spring strength.

10. The paper sheet stacking apparatus according to claim 1, wherein the rotary member has two or more blades, each blade being capable of touching a paper sheet stack.

11. The paper sheet stacking apparatus according to claim 10, wherein the blades of the rotary member each have an L-shaped free end.

12. The paper sheet stacking apparatus according to one of claim 1, further comprising:

a guide for preventing the paper sheets being led from proceeding toward the rotation axis of the rotary member, wherein the guide has a window, through which the rotary member extends through the window towards the support member, and wherein said support member is positioned to define a space between said support member and said guide such that the width of the space is matched to the extension of said rotary member through said window.

13. The paper sheet stacking apparatus according to claim 1, wherein the bottom plate is higher in level on its side, on which the paper sheets are led into the apparatus, than the side with the side plate provided thereon.

14. The paper sheet stacking apparatus according to claim 2, wherein a plurality of springs having different spring strengths pull the support member toward the rotary member.

15. The paper sheet stacking apparatus according to claim 2, which further comprises a wire having one end tied to the support member and the other end secured at a fixed position and a movable pulley with the wire passed thereround, the spring member pulling the support member toward the rotary member by pulling the movable pulley.

16. The paper sheet stacking apparatus according to claim 3, which further comprises a wire having one end tied to the support member and the other end secured at a fixed position and a movable pulley with the wire passed thereround, the spring member pulling the support member toward the rotary member by pulling the movable pulley.

17. The paper sheet stacking apparatus according to claim 4, which further comprises a wire having one end tied to the support member and the other end secured at a fixed position and a movable pulley with the wire passed thereround, the spring member pulling the support member toward the rotary member by pulling the movable pulley, wherein the support member is displaced to a position at which a gravitational force of the paper sheets and the support member are in equilibrium with the spring force of said spring member.

18. The paper sheet stacking apparatus according to claim 5, which further comprises a wire having one end tied to the support member and the other end secured at a fixed position and a movable pulley with the wire passed thereround, the spring member pulling the support member toward the rotary member by pulling the movable pulley.

19. The paper sheet stacking apparatus according to claim 2, wherein the rotary member has two or more blades, each blade being capable of touching a paper sheet stack.

20. The paper sheet stacking apparatus according to claim 3, wherein the rotary member has two or more blades, each blade being capable of touching a paper sheet stack.

21. A paper sheet stacking apparatus for stacking paper sheets upright comprising:

bottom plate for stacking paper sheets being led upright;

a the bottom plate for stopping paper sheets led to the a side plate mounted above bottom plate;

a rotary member mounted above the bottom plate and having at least an intermittent member rotated to intermittently contact the paper sheets being led to the bottom plate and to position the paper sheets proximate to the side plate;

a support member facing the rotary member and preventing the paper sheets being led upright from turning down onto the bottom plate, wherein said bottom plate is slanted such that the paper sheets led into the apparatus are guided toward the support member;

a first spring member having a first spring strength and a second spring member having a second spring strength that pull the support member toward the rotary member, said first spring strength being lower than said second spring strength; and a stopper disposed for determining the position at which the second spring member becomes active when a force or the stack due to volume increase thereof exceeds the first spring strength of the first spring member.

22. The paper sheet stacking apparatus according to claim 21, wherein the rotary member has two or more intermittent members, each intermittent member being capable of touching a paper sheet stack.

23.The paper sheet stacking apparatus according to claim 21, further comprising:

a guide for preventing the paper sheets being led from proceeding toward a rotation axis of the rotary member, wherein said guide includes a window through which the rotary member partially extends towards the support member.

24. The paper sheet stacking apparatus according to claim 23, wherein said support member is positioned to define a space between said support member and said guide such that the width of the space is matched to the extension of said rotary member through said window.

25. The paper sheer stacking apparatus according to claim 21, wherein the support member is displaced to a position at which a gravitational force of the paper sheets and the support member are in equilibrium with the spring strengths from said first and second spring members.

26. A method for stacking paper sheets, comprising:

leading paper sheets onto a bottom plate for stacking said sheets in an upright position;

stopping said paper sheets led onto the bottom plate with a side plate mounted above the bottom plate;

intermittently contacting the paper sheets being led to the bottom plate with a rotary member to position the paper sheets proximate to the side plate;

preventing, with a support member, the paper sheets being led to the bottom plate from turning down onto the bottom plate;

changing a distance between the support member and the rotary member;

forcing the support member toward the rotary member; and slanting the bottom plate such that the paper sheets stacked onto the bottom plate are guided toward the support member.

27. The method for stacking paper sheets according to claim 26, further comprising:

guiding the paper sheets towards the rotary member using a guide having a window through which the rotary member partially extends.

28. The method for stacking paper sheets according to claim 26, wherein said guiding the support member toward the rotary member comprises providing an increasing pulling force with a first spring having a first spring strength that becomes active when gravitational force of the stack due to volume increase thereof exceeds a second spring strength of a second spring, said second spring strength being lower than that of said first spring strength.

29. The method for stacking paper sheets according to claim 26, wherein said intermittently contacting the paper sheets comprises providing said rotary member with an intermittent member, each intermittent member being capable of contacting said paper sheet sheets.

30. The method for stacking paper sheets according to claim 27, wherein the support member is positioned to define a space between said support member and said guide such that the width of the space is matched to the extension of said rotary member through said window.

31. The method for stacking paper sheets according to claim 28, wherein said providing an increasing pulling force comprises displacing said support member to a position at which a gravitational force of the paper sheets and the support member are in equilibrium with the spring strengths from said first and second spring members.

* * * * *